US005472114A

United States Patent [19]

Cragun

[11] Patent Number: 5,472,114

[45] Date of Patent: Dec. 5, 1995

[54] TURRET MAGAZINE ASSEMBLY

[75] Inventor: John E. Cragun, Deerwood, Minn.

[73] Assignee: Riverwood International Corporation, Denver, Colo.

[21] Appl. No.: 273,346

[22] Filed: Jul. 11, 1994

[51] Int. Cl.[6] ..... G07F 11/12

[52] U.S. Cl. ..... 221/11; 221/105

[58] Field of Search ..... 221/105, 11, 117, 221/133, 104, 113

[56] References Cited

U.S. PATENT DOCUMENTS

| | | | |
|---|---|---|---|
| 2,325,165 | 7/1943 | Goodwin | 226/88.1 |
| 2,906,072 | 9/1959 | Carlson | 53/67 |
| 2,919,830 | 1/1960 | Anderson | 221/11 |
| 3,120,324 | 2/1964 | Amberg et al. | 221/4 |
| 3,520,444 | 7/1970 | Manzer et al. | 221/11 |
| 3,698,601 | 10/1972 | Sierk et al. | 221/105 |
| 3,807,600 | 4/1974 | Moss et al. | 221/11 |
| 3,929,326 | 12/1975 | Seragnoli | 221/105 |
| 3,937,360 | 2/1976 | Doucette | 221/11 |
| 4,558,802 | 12/1985 | Molison | 221/11 |
| 4,799,605 | 1/1989 | Kronseder | 221/11 |
| 5,024,348 | 6/1991 | Kronseder | 221/11 |
| 5,253,782 | 10/1993 | Gates et al. | 221/105 |

*Primary Examiner*—Kenneth Noland
*Attorney, Agent, or Firm*—Anthony G. Eggink

[57] ABSTRACT

A turret magazine assembly which provides a constant supply of articles in a packaging operation. The turret magazine assembly has a rotatable feeding assembly having a plurality of tube receiving structures. A plurality of removable tubes are provided to receive and dispense a supply of articles. Each removable tube has a gate mechanism mounted at its dispensing end. A fixed feeding tube is provided having an inlet end and an outlet end. The turret magazine assembly has a control mechanism including an article flow detector to determine article flow. An indexing structure is provided which is operative on the rotatable feeding assembly and which is activated by the control mechanism. The indexing structure is constructed and arranged to successively align the dispensing ends of the respective removable tubes with the inlet end of the fixed feeding tube.

19 Claims, 8 Drawing Sheets

TURRET MAGAZINE ASSEMBLY

BACKGROUND OF THE INVENTION

This invention relates to continuous packaging operations and article placement assemblies and processes. Particularly, this invention relates to a turret magazine assembly to provide a continuous supply of articles, such as labels, coupons, pouches, cartons and like objects, for subsequent placement in continuous packaging operations.

Supply magazines are used in packaging operations to hold and provide a specified quantity of articles, such as labels or carton blanks, for example. Typically, the supply magazines are positioned at predetermined locations to cooperate with an article transfer device which may utilize a rotating vacuum cup structure which removes one article at a time from the supply magazine and places each article onto a moving conveyor or onto a object transported on the conveyor, for example. A single magazine, however, requires continued monitoring by the machine operator to ensure that the supply of articles is not depleted during the packaging operation. Continual monitoring, however, is inefficient particularly in high speed packaging operations and any article supply depletion during the operation may result in costly downtime. The turret magazine of the present invention provides a continuous supply of articles and which requires significantly less monitoring on the part of the machine operator.

Although various turret type article supply assemblies have been proposed and used in the article placement art to index and fill a feed magazine structure, these prior art turret supply assemblies have limitations and drawbacks relating to the requirements of high speed packaging operations, and particularly in the high speed transfer of articles. For example, prior art article supply assemblies are typically designed for holding and dispensing specifically shaped articles, such as bottle caps, can covers, cups and bottle carriers. Any associated turret structure, as a result, has specific requirements and, thus, typically has a unique and specific configuration to process these articles. The turret magazine assembly of the present invention relates particularly to providing a continuous supply of labels, coupons, pouches, carton blanks and like articles.

SUMMARY OF THE INVENTION

A turret magazine assembly is disclosed to provide a constant supply of articles in a packaging operation. The turret assembly has a rotatable feeding assembly with a plurality of removable tubes, each being constructed and arranged to receive and dispense a supply of articles. The removable tubes have a top end and a bottom dispensing end. A fixed feeding tube is provided having an inlet end and an outlet end. The turret magazine assembly further has a control mechanism which includes means to detect article flow from the removable tubes. Further, an indexing structure is provided which is operative on the rotatable feeding assembly.

The indexing structure is activated by the control mechanism and is constructed and arranged to successively align the dispensing ends of the removable tubes with the inlet end of the fixed feeding tube. The removable tubes of the turret magazine assembly each have a gate mechanism mounted at the dispensing end and which is activated by the control mechanism. The rotatable feeding assembly indexes and aligns the removable tube with the inlet end of the fixed feeding tube. The fixed feed tube of the turret magazine assembly has an article supply indicating means and which is coupled to the control mechanism.

These and other benefits of this invention will become clear from the following description by reference to the drawings.

BRIEF DESCRIPTION OF THE DRAWINGS

FIG. 1(*a*) is a schematic view showing the control mechanism of the invention;

DESCRIPTION OF THE PREFERRED EMBODIMENT

Figure 1:
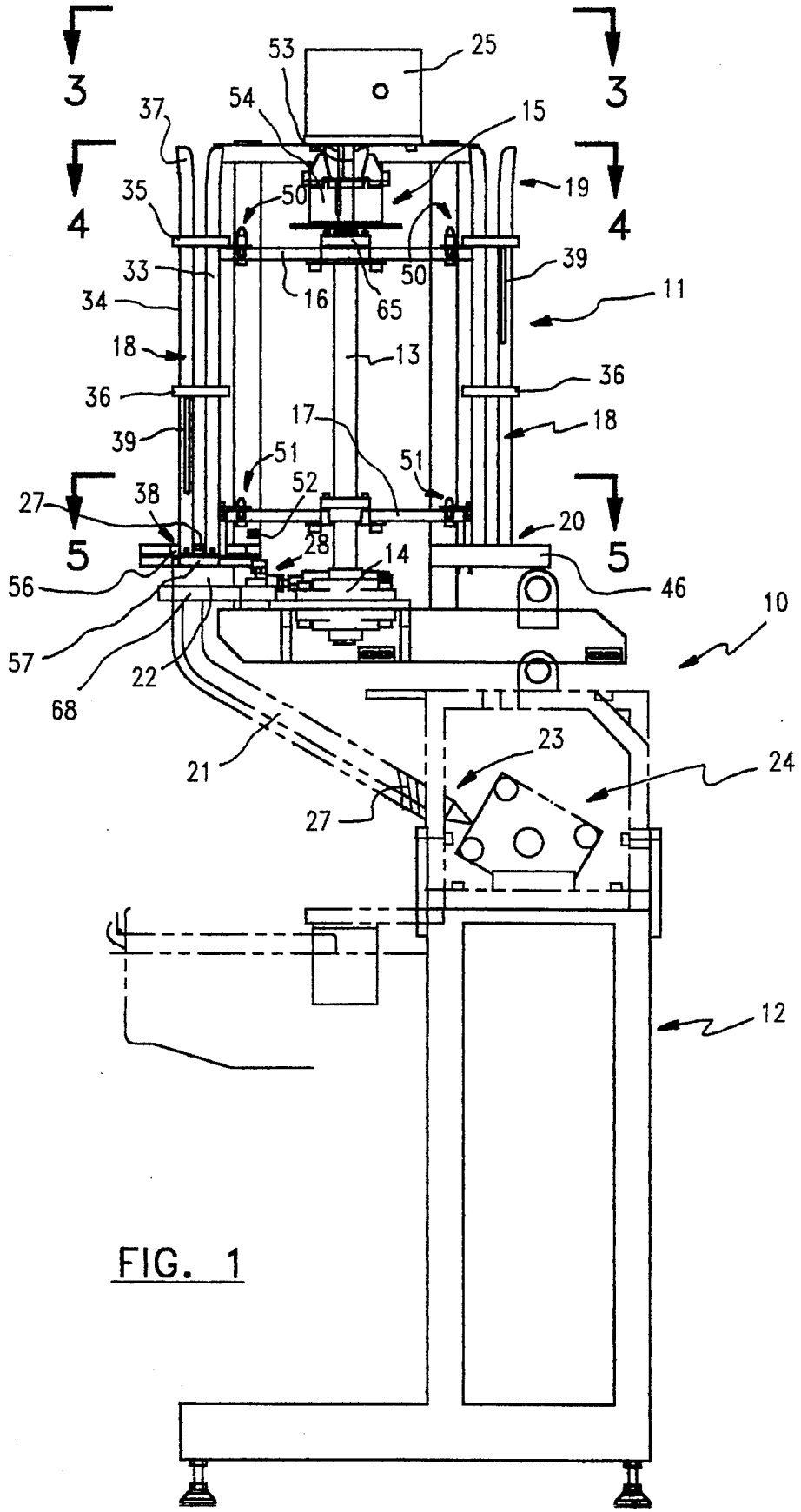
FIG. 1 is a lateral plan view showing the turret magazine assembly of this invention.
Figure 2:
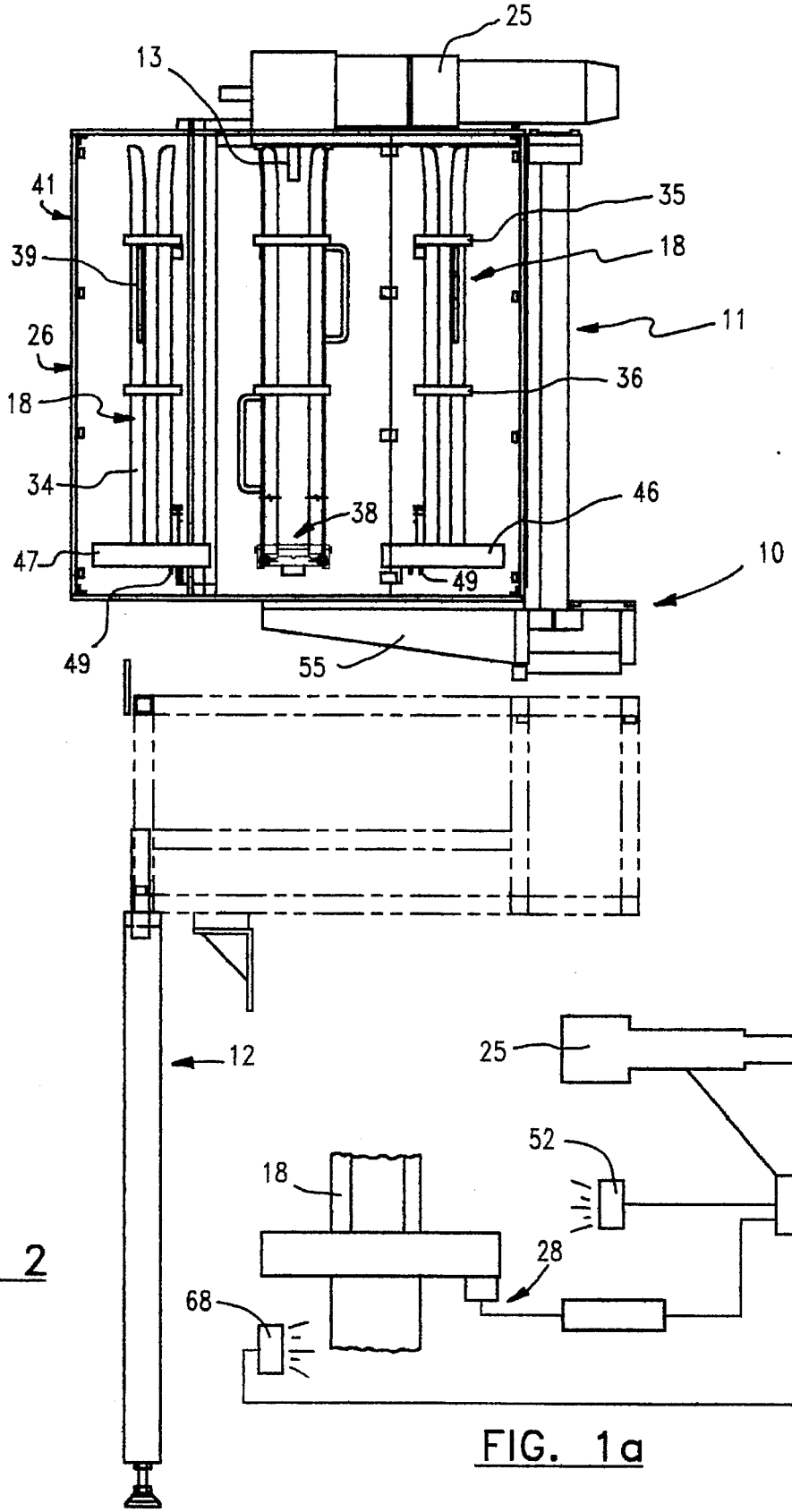
FIG. 2 is a front plan view of the turret magazine assembly of FIG. 1.
Figure 1A:
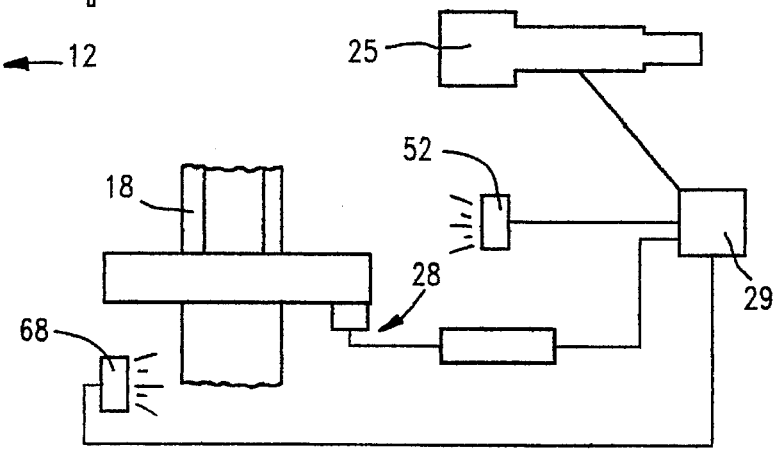
Figure 3:
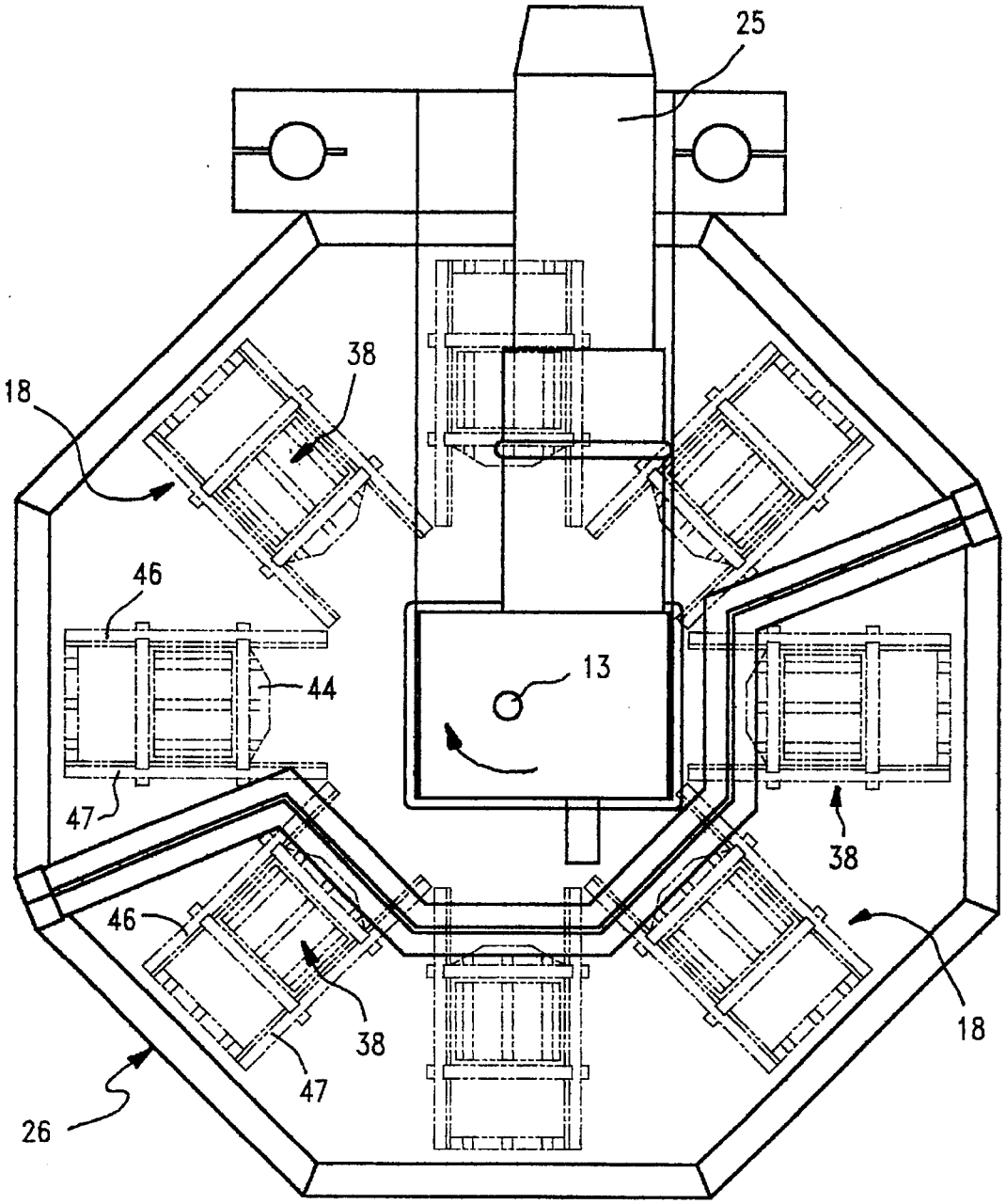
FIG. 3 is a sectional view of the assembly taken along lines 3—3 of FIG. 1.

Referring to FIGS. 1–5, a turret magazine assembly 10 is shown having a rotating assembly 11 which is mounted for rotation on a frame or stand 12. The turret magazine assembly 10 is further shown to have a downwardly and angularly extending feeding tube 21 having an upper end 22 and a bottom end 23. The bottom end 23 of the fixed tube 21 is positioned to cooperate with an article transfer device 24 which may be mounted within the frame 12.

The rotating assembly 11 is shown contained within a housing structure 26 which is preferably constructed of a clear plastic for visibility of the assembly operation. The housing structure 26 has hinged doors 41 with handle members to permit entry by the assembly operator.

The turret magazine assembly 10 of the invention provides a continuous supply of articles 27, such as labels, coupons, pouches, cartons and like objects, for subsequent use and/or placement in packaging operations. The rotatable assembly 11 is shown to have a plurality of removable article holding structures or article supply tubes 18. The magazine assembly 10 provides a continuous gravity flow of articles 27 from the removable article supply tubes 18 that are mounted on the rotating feed assembly 11. Each supply tube 18 has a flared top end 19 for receiving stacks of articles, each of which is dispensed through the bottom end 20 of the tube 18. The assembly 11 has a control mechanism 29 which causes the assembly 11 to successively index and align the bottom ends 20 of the supply tubes 18 with the feed tube 21.

The feed tube 21 has a bottom end 23 which is constructed and arranged to present the individual articles 27 for pickup. The article transfer device 24 may be a vacuum operated assembly having vacuum cups to successively grasp, transfer and place the bottom article from article stack 27 onto moving objects, for example. Applicants' assignee disclose such transfer devices in U.S. Pat. No. 4,530,686 entitled "Rotary Packaging Technology", U.S. Pat. No. 4,643,633 entitled "Rotary Transfer Device" and U.S. Pat. No. 4,901,843 entitled "Advancing Motion Rotary Apparatus", the respective teachings of which are incorporated by reference herein.

As further shown, the rotating feed assembly 11 has an axially mounted rotatable shaft 13 which is mounted between top bushing 15 and bottom hub 14. Top and bottom support structures or turret wheels 16 and 17 are spacially mounted for rotation with shaft 13. The support structures 16 and 17 have aligned peripheral indentations or tube receiving means which are evenly spaced; eight being shown in the structure of the drawings. However, although eight such removable tubes are shown, it is important that more than one such tube 18 be provided for purposes of the present invention. The plurality of article supply tubes 18 are each removably mounted to the support structures 16 and 17 and may be easily moved for refilling a stack of articles 27.

Figure 7:
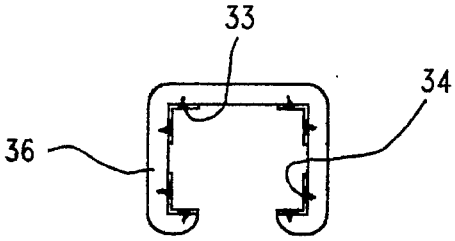
FIG. 7 is a sectional view of the article supply tube.

The article supply tubes 18 are shown to be constructed of elongated side members or rails 33 and 34 which are united by support members or brackets 35 and 36. FIG. 7 shows member 36 connected to the side members 33 and 34 of supply tube 18. The tubes 18 have flared tops 37 and bottom ends 20 at which a movable retention structure or slidable gate mechanism 38 is positioned to hold the articles 27 thereabove. The article retention structures or gate mechanisms 38 are positioned at the bottom 20 of each article supply tube 18 and are shown to be comprised of slidable gate structures 38 which are activated into opened and closed positions as will be further described below. The article supply tubes 18 are connected to the top and bottom support plates 16 and 17 by means of upper and lower locking structures 50 and 51. At least one handle member 39 is attached to each tube 18 for installation and removal by the assembly operator.

Shown at the bottom end of each article supply tube 18 are bottom slide rails 46 and 47 which are part of the slidable gate mechanisms 38 and which will be further described below. The rotating feed assembly 11 and, thus, the article supply tubes 18 are rotated by control mechanism 29 which initiates an index activating process and which aligns successive gate mechanisms 38 in cooperative relationship with the top end 22 of the feeding tube 18. The index activating process includes communication from at least one article sensor, an activator mechanism 28 and a clutch and motor assembly 25 which is shown positioned in a working relationship at the top of drive shaft 13. FIG. 1(*a*) shows a schematic view of the control mechanism 29 and its communication with the elements it controls. The drive motor structure 25 is further shown to have an output shaft 53 and a clutch mechanism 54. The index activating process further includes the activator mechanism 28 which includes a cam/cam follower arrangement which controls the operation of the slidable gate structure 38.

Figure 4:
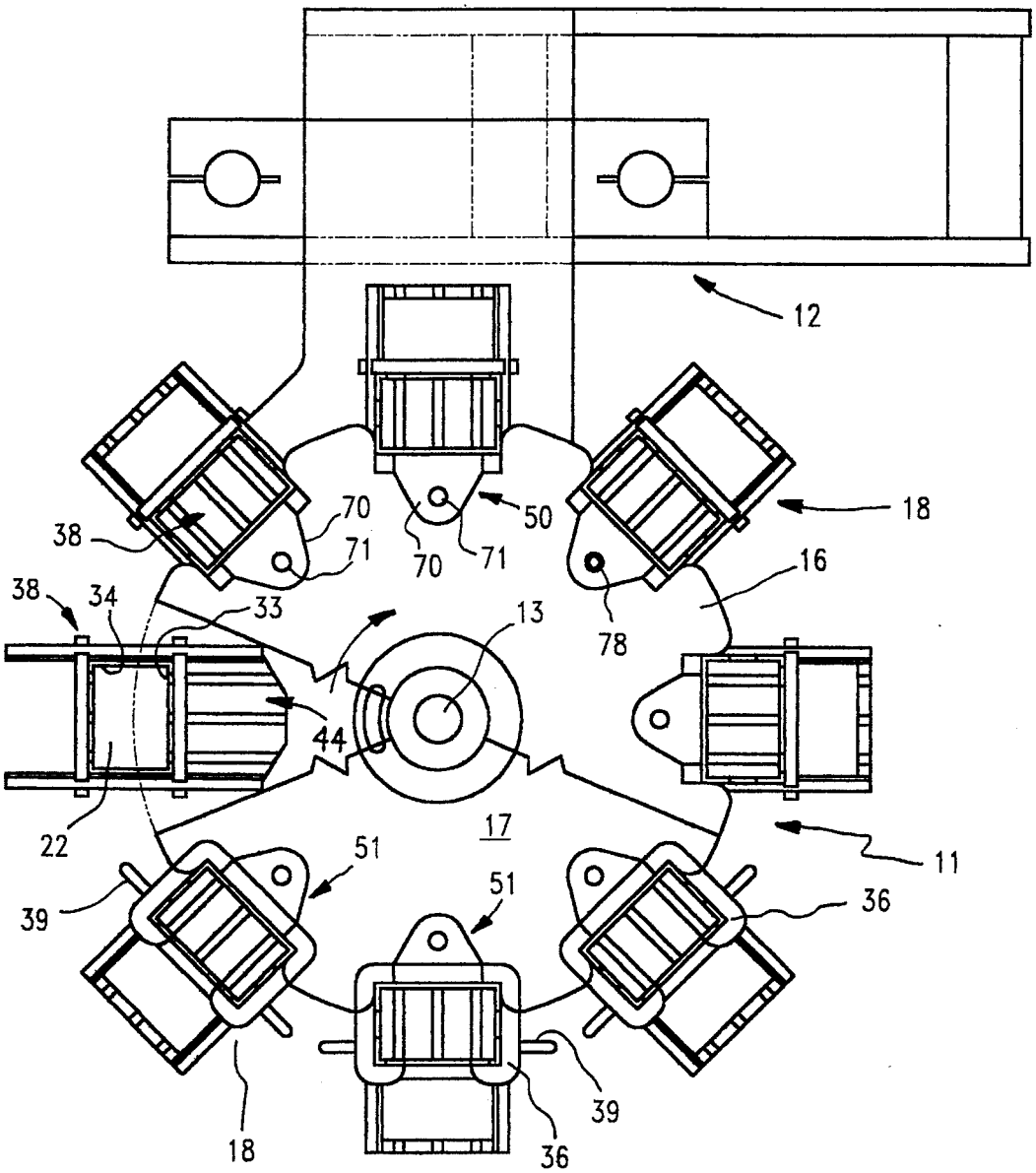
FIG. 4 is a sectional view of the assembly taken along lines 4—4 of FIG. 1.

FIG. 4 particularly shows the locking structures 50 of the article supply tubes 18 which is comprised of a locking pin 78 which is connected to the top support structure 16. Each tube 18 has a tab 70 and an aperture 71 in tab 70 for engaging locking pin 78 which is mounted to the top turret wheel 16. A similar locking arrangement is provided by locking structures 51 in cooperation with bottom structure 17. Preferably, the locking pins on turret wheel 17 are longer than those of the upper turret wheel 16. This arrangement permits easy alignment of the tubes 18 for placement onto the feed assembly 11. Further shown is the inlet end 22 of feed tube 21 above which the supply tubes are rotated. The activating mechanism which operates the gate mechanisms 38 of the rotating supply tubes 18 is further shown to comprise a cooperating sliding mechanism.

Figure 5:
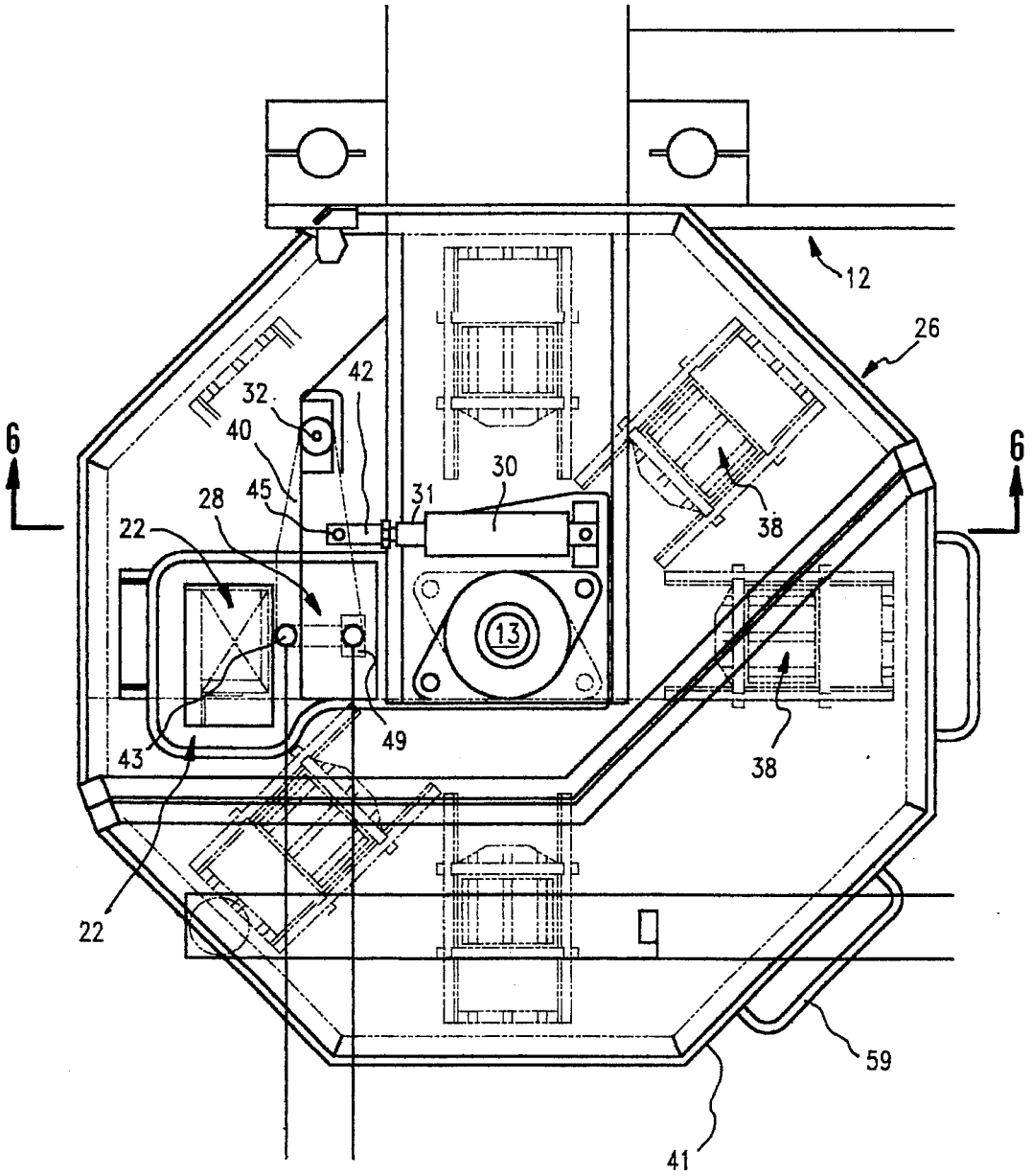
FIG. 5 is a sectional view of the assembly taken along lines 5—5 of FIG. 1.
Figure 6:
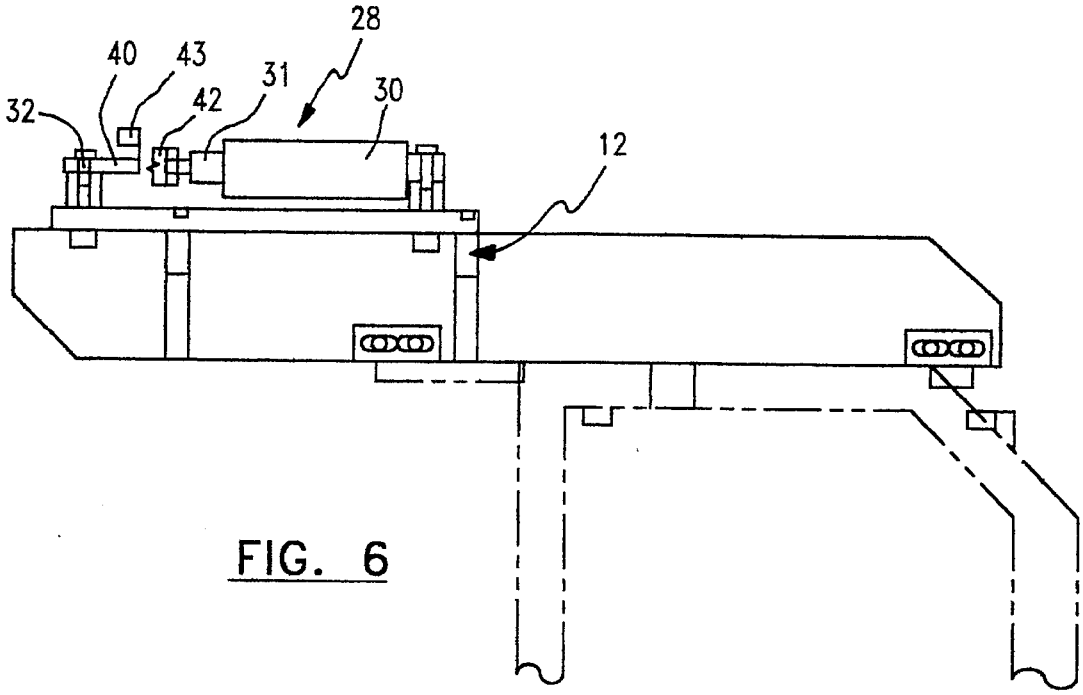
FIG. 6 and FIG. 11*a* is a lateral view of the gate activating mechanism shown in FIG. 1.

FIGS. 5 and 6 show the gate activating mechanism 28 to be comprised of an air cylinder 30 having a piston 31 which controls the movement of a cam follower 43. The cam follower 43 is further shown connected to a pivot arm 40 which is held by pivot pin 32 at one end. As the supply of articles 27 is depleted, the piston 31 is caused to slide inward to, thereby, close the gate mechanism 38. Thereafter the assembly 11 is indexed to position successive supply tubes 18 in alignment with the top end 22 of the feed tube 21. Alternative means may be used to index the feed assembly 11, for example, by the utilization of a microswitch structure rather than the photoeye mechanisms described herein. Further, although the feed assembly 11 is shown to be rotated or indexed in a clockwise direction, the functionality of the assembly 11 is the same if rotated in a counterclockwise direction by means of the drive structure 25. A cylinder 30 with piston 31 is described herein to function in cooperation with the pivot arm 40 to activate or move the cam follower 43. The important aspect of the invention, however, is the opening and closing of the gate mechanism 38 to empty the contents of the article supply tubes 18 into the feeding tube or conduit 21. Thus, an activation member other than an air cylinder 30 may be utilized within the purview of the present invention.

Figure 8:
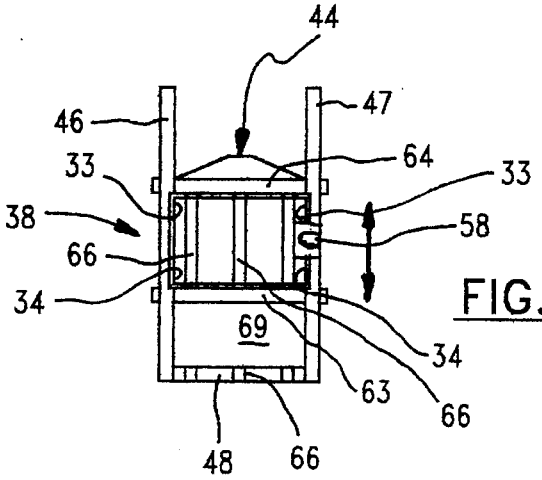
FIG. 8 is a top view showing the gate mechanism of the removable tubes of the invention.
Figure 9:
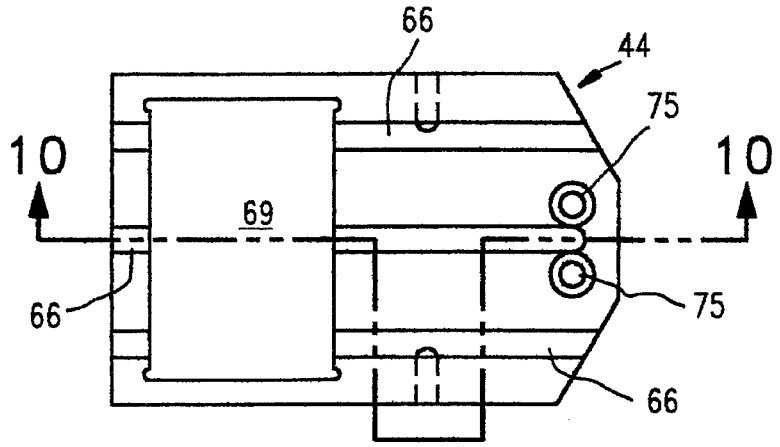
FIGS. 9–11 are top, sectional and bottom views, respectively, of the gate mechanism.
Figure 10:
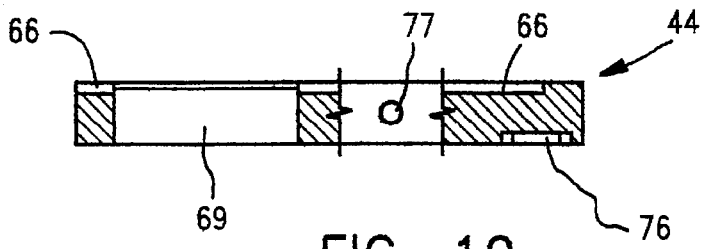
Figure 11:
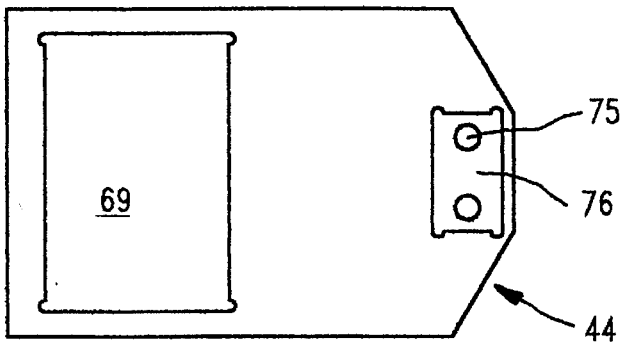
Figure 11A:
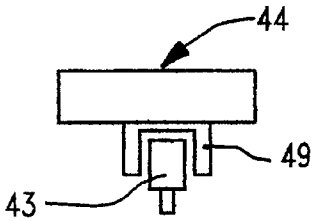
Figure 12:
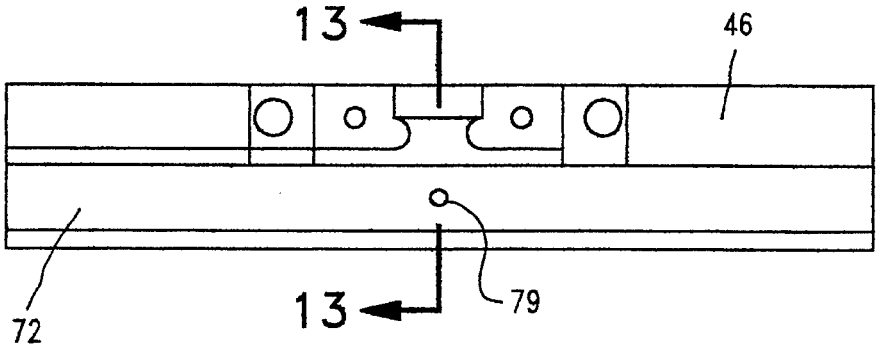
FIGS. 12 and 13 are side and sectional views, respectively, of the slide rail structures used in conjunction with the gate mechanism of the present invention.
Figure 13:
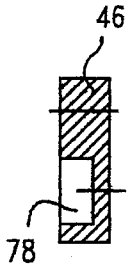
Figure 14:
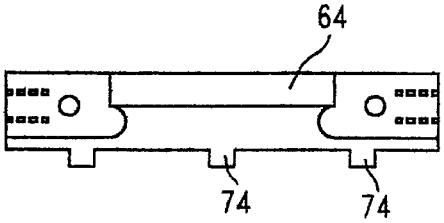
FIGS. 14 and 15 are frontal views of the members mounted to the slide rail structures of FIGS. 12 and 13 which are mounted on the bottom of each article supply tube of the invention.
Figure 15:
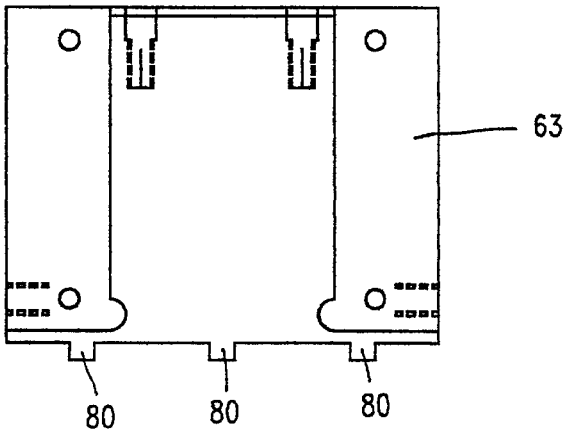

FIG. 8 shows the slidable gate mechanism 38 of this invention. A pair of slide rails 46 and 47 are mounted to the bottom of the elongated side members 33 and 34 of the supply tube 18. A slidable carriage 44 is shown positioned in the slide rails 46 and 47. As shown, the gate mechanism 38 is in a closed position whereby the stack of articles is positioned between the connecting members 63 and 64. The slidable carriage 44 has an open slot 69 through which the article stack 27 falls when the carriage 44 is moved into an open position. As will be further described, the carriage 44 has slide grooves 66 which cooperate with slide finger disposed at the bottom of the connecting members 63 and 64.

As further shown in FIGS. 9–13, the gate mechanism 38 is comprised of a slidable carriage 44 which moves in and with respect to the opposing slide rails 46 and 47 which are attached at the bottom of the side members or magazine rails 33 and 34 of each article supply tube 18. The carriage 44 has an opening or slot 69 through which the articles are dispensed when the gate mechanism 38 is in a open position. The carriage 44 is slidably mounted in the elongated slots 72 and 73 of the bottom rails 46 and 47. As further shown, opposing connecting members 63 and 64 are fixed to the bottom rails 46 and 47. The article stack 27 is shown disposed above the upper surface of the carriage 44 when the gate mechanism 38 is in the closed position. As further shown, the carriage 44 has elongated channels 66 which are aligned with slide fingers 74 which extend from the bottom of connecting member 64. Connecting member 63 has similarly disposed slide fingers 80 for engaging the channels 66 of the carriage 44. The slide fingers 80 of connecting member 63 in cooperation with the channels 66 of carriage 44 are provided so that during the opening process of the gate mechanism 38 that the bottom most article in the stack is maintained in position and not moved along with the carriage 44.

A U-shaped bracket or cam track 49 is shown mounted at the bottom of the forward end of the carriage 44. The bracket 49 is positioned to engage the cam follower 43 shown in FIGS. 6 and 11(*a*). Thus, as the feed assembly 11 is indexed toward the fixed feed tube 21 position, the respective bracket 49 of the gate mechanism 38 is brought in alignment with the cam follower 43. A ball plunger mechanism 58 is further shown which permits the slidable carriage 44 to be locked on slide rail 47 when in the closed position. As will be further described, the plunger mechanism 58 functions in cooperation with indents or small apertures in the carriage 44 and the bottom slide rails 46 and 47. The plunger mechanism has a ball or similar object which seats in the aligned indents to maintain the slide in a closed position during refill of articles into the supply tube 18 and during the process of placement back onto the feed assembly 11.

The turret magazine assembly 10 has a control mechanism 29 which controls the operation and sequence of operation of the drive motor 11 and the cylinder 30. The control mechanism 29, as shown in FIG. 1(*a*), is in communication with article sensors, such as photoeyes, 52 and 68. The control mechanism 29 initiates the turning or indexing of the turret magazine assembly 10.

During operation of the continuous packaging process, the article transfer device 24 sequentially removes the bottom article from the article stack 27 at the bottom end 23 of the feeding tube 21. When sensor or detector 68 detects the height of the article stack 27 falling below its line of detection, the air cylinder 30 is activated and which contracts to pull the carriage 44 of gate mechanism 38 into a closed position with respect to the article supply tube 18. Subsequently, the rotatable assembly 11 is indexed (40 degrees in the assembly shown) to position the next supply tube 18 in alignment with the top end 22 of feeding tube 21. At this time, the sensor or detector 52 ensures that the aligned supply tube 18 has a supply of articles 27. If the signal is negative, the control mechanism 29 indexes the feed assembly to the next supply tube 18. If the signal is positive, the control mechanism 29 activates the cylinder 30 to, thereby, move the carriage 22 into an open position by means of the cam follower 43 action on the structure 49 of the gate mechanism 38. Further, if the signal from the detector 52 is negative, i.e., an article supply is not detected by means of the photoeye, for example, a warning light may be activated to signal the operator that the assembly 11 will be indexed. Should the housing 26 be opened during this time period prior to indexing to a full supply tube 18, the turret magazine assembly will be shut-off.

In operation, the article transfer device 24 continually contacts and removes the bottom article from the stack of articles 27 located in feeding tube 21. The feeding tube 21 continually is filled by means of article supply tubes 18 indexed thereabove. As detector 68, positioned at the top end 22 of the feeding tube 21, is activated by the emptying of an article supply tube 18, the gate mechanism 38 is closed and the rotatable feed assembly is indexed to a successive and filled supply tube 18. This operation permits the continuous article flow from the supply tubes 18 into the feeding tube 21.

As many changes are possible to the embodiments of this invention utilizing the teachings thereof, the descriptions above, and the accompanying drawings should be interpreted in the illustrative and not the limited sense.

That which is claimed:

1. A turret magazine assembly to provide a constant supply of articles comprising:

a) a rotatable feeding assembly having a plurality of circumferentially disposed tube receiving and locking means, said assembly comprising a rotatable shaft having spaced support structures being vertically aligned and being constructed and arranged to releasably fix a plurality of article supply tubes thereto;

b) a plurality of removable article supply tubes for receiving and dispensing a supply of articles, each said tube having a dispensing end, said removable tubes being constructed and arranged to be removably fixed in said circumferentially disposed tube receiving and locking means of said spaced support structures;

c) a fixed feeding tube having an inlet end and an outlet end;

d) means to detect article flow from said removable tubes; and e) an indexing mechanism operative on said rotatable feeding assembly, said indexing means being activated by said means to detect and being constructed and arranged to successively align said dispensing ends of said removable tubes with said inlet end of said fixed feeding tube.

2. The turret magazine assembly of claim 1, wherein each said removable tube has a gate mechanism mounted at said dispensing end.

3. The turret magazine assembly of claim 2, wherein said gate mechanism is comprised of opposing slide rail members and a slidable member.

4. The turret magazine assembly of claim 1, wherein said assembly further has a control assembly in communication with said indexing mechanism.

5. The turret magazine assembly of claim 1, wherein said means to detect is a low article level indicating means coupled to said indexing means.

6. The turret magazine assembly of claim 1, wherein said indexing mechanism is comprised of a motor and clutch assembly operatively connected to said rotatable shaft.

7. The turret magazine assembly of claim 1, wherein each said removable tube is comprised of a plurality of elongated members.

8. The turret magazine assembly of claim 1, wherein an article placer device is positioned at said outlet end of said fixed feeding tube.

9. The turret magazine assembly of claim 1, wherein said rotatable feeding assembly has an exteriorly disposed enclosure with at least one hinged door to provide access.

10. A magazine assembly to provide a constant supply of articles comprising:

a) a rotatable assembly having a plurality of removable article holding structures;

b) a feeding tube assembly positioned for alignment with said removable article holding structures;

c) an activation assembly and a control assembly for indexing said rotatable assembly in alignment with said feeding tube assembly, said activation assembly including a pneumatic cylinder, a clutch and motor in driven communication with said rotatable assembly; and d) a closure mechanism positioned in each removable article holding structure.

11. The magazine assembly of claim 10, wherein said closure mechanism is comprised of a slidable gate mechanism.

12. The magazine assembly of claim 11, wherein said gate mechanism includes opposing rails mounted at the bottom of each article holding structure, a slidable carriage and a cam track portion mounted on said carriage.

13. The magazine assembly of claim 12, further including a cam follower positioned adjacent said feeding tube assembly and being in communication with said control assembly.

14. The magazine assembly of claim 10, wherein said pneumatic cylinder is constructed and arranged for acting upon said closure mechanism.

15. The magazine assembly of claim 10, wherein said activation assembly includes a low article level indicating means positioned in said feeding tube assembly.

16. The magazine assembly of claim 10, wherein said rotatable assembly includes a rotatable shaft and a pair of spaced turret wheels mounted thereto.

17. The magazine assembly of claim 16, wherein said turret wheels have aligned indentations and locking means to receive and hold said removable article holding structures.

18. A magazine assembly to provide a constant supply of articles comprising:

a) a rotatable assembly having a plurality of removable article holding structures, each said removable article holding structure having a top end and a bottom end;

b) a feeding tube assembly positioned for alignment with said rotatable assembly and said removable article holding structures;

c) a control assembly for indexing said rotatable assembly in alignment with said feeding tube assembly, said control assembly including article sensing means constructed and arranged to signal when the article supply reaches a predetermined level in said feeding tube assembly;

d) an activatable article retention structure positioned at the bottom of each said removable article holding structure; and e) an activation assembly to open and close said article retention structure of said removable article holding structures when each said removable article holding structure is indexed in alignment with said feeding tube assembly.

19. A turret magazine assembly to provide a constant supply of articles comprising:

a) a rotatable assembly having a generally circularly disposed radial support structure:

b) a plurality of removable tubes each being constructed and arranged to be fixed in said radial support structure;

c) a feeding tube assembly positioned for alignment with said removable article holding structures;

d) an activation assembly and control assembly for indexing said rotatable assembly to align said removable tubes with said feeding tube assembly; and e) activatable article holding structures positioned at the bottom of each said removable tube and being controlled by said activation assembly to permit articles to be dispensed from said removable tubes into said fixed feeding tube assembly when in alignment therewith.

* * * * *